US005966855A

United States Patent [19]

Miner

[11] Patent Number: 5,966,855

[45] Date of Patent: Oct. 19, 1999

[54] CRYOPHOTONIC BACK-LIT SIGN

[76] Inventor: Race K. Miner, 1807 Walnut St, Camp Hill, Pa. 17011

[21] Appl. No.: 08/991,535

[22] Filed: Dec. 16, 1997

[51] Int. Cl.[6] ..... G09F 13/22

[52] U.S. Cl. ..... 40/541; 40/615

[58] Field of Search ..... 40/564, 582, 612, 40/541, 615, 586; 362/812, 84

[56] References Cited

U.S. PATENT DOCUMENTS

| | | | |
|---|---|---|---|
| 2,910,792 | 11/1959 | Pfaff, Jr. . | |
| 3,510,976 | 5/1970 | Pauline et al. | 40/132 |
| 3,670,067 | 6/1972 | Coolbaugh et al. | 264/154 |
| 4,005,538 | 2/1977 | Tung | 40/132 |
| 4,042,919 | 8/1977 | Patty | 40/586 X |
| 4,457,089 | 7/1984 | Phillips, Jr. | 40/615 X |
| 4,645,970 | 2/1987 | Murphy | 313/509 |
| 5,007,190 | 4/1991 | Shyu | 40/564 |
| 5,095,253 | 3/1992 | Brent | 315/276 |
| 5,245,516 | 9/1993 | De Haas et al. | 362/84 X |
| 5,276,424 | 1/1994 | Hegemann | 40/586 X |
| 5,300,783 | 4/1994 | Spencer et al. | 250/462.1 |
| 5,315,491 | 5/1994 | Spencer et al. | 362/84 |
| 5,339,550 | 8/1994 | Hoffman | 362/84 X |
| 5,634,835 | 6/1997 | Wu et al. | 445/24 |
| 5,692,327 | 12/1997 | Wynne et al. | 362/812 X |
| 5,755,051 | 5/1998 | Zumbuhl | 40/586 |

FOREIGN PATENT DOCUMENTS 2 099 628 12/1982 United Kingdom .

*Primary Examiner*—Joanne Silbermann
*Attorney, Agent, or Firm*—Foley & Lardner

[57] ABSTRACT

A cryophotonic back-lit sign for use at night or during low-light conditions. The sign includes an AC ballast for providing a source of AC power. A cryophotonic lamp is disposed in a potting material, that is preferably made from mixing together a two-part epoxy. The lamp is connected to receive the AC power from the AC ballast. A retroreflective sheeting is provided on a transparent substrate, which is removably attached to a top surface of the potting material. The sheeting allows light to substantially pass from a rear surface thereof to a front surface thereof. Light is provided to illuminate the sign either from light from vehicle headlights that reflect off the sheeting and back towards the vehicle, or from the cryophotonic lamp when not enough light is available to illuminate the sheeting.

20 Claims, 5 Drawing Sheets

CRYOPHOTONIC BACK-LIT SIGN

BACKGROUND OF THE INVENTION

1. Field of the Invention

The present invention relates to the use of a cryophotonic panel or lamp for providing back lighting for a sign. In particular, the present invention relates to the use of a cryophotonic panel or lamp together with a translucent retroreflective sheeting in order to provide sufficient back lighting for a sign to be seen at night or during dimly-lit times during the day.

2. Description of the Related Art

Traffic signs provide information that is useful for a driver of a vehicle. For example, traffic signs may provide an indication of an upcoming exit, a maximum safe vehicle speed, or the like. During the daytime, traffic signs are readily visible to a vehicle operator. However, traffic signs also need to be visible at night or during dark periods of the day (i.e., such as during a rainstorm), and something other than sunlight has to be used in order to make such signs visible to the vehicle operator.

Accordingly, several different types of signs have been manufactured so as to make traffic signs visible at night, as well as during the daylight hours. One such conventional traffic sign is disclosed in U.S. Pat. No. 2,910,792, issued to H. C. Pfaff, Jr. Pfaff discloses a highway sign that has an electrically energized luminescent material containing layer. The layer includes light reflecting members fixed or embedded onto a surface thereof. When the luminescent layer is excited with alternating or high frequency current, particles in the layer become luminescent. When headlights of a vehicle provide light rays that impinge on the light reflecting members, those members reflect the light rays back, so as to provide a lighting capability for the sign. The luminescent material layer is secured to a metal base plate by baking or firing, and no provision is provided for protecting that layer from problems associated with neighboring components, such as the light reflecting members.

U.S. Pat. No. 3,510,976, issued to R. F. Pauline et al., discloses a traffic sign that has a reflective face by virtue of beads disposed on a surface thereof. An electric bulb is disposed behind the reflective face, inside the sign itself. The electric bulb provides light that passes through the reflective face so as to provide lighting for the sign when there is not enough ambient light (such as from headlights of a car) that can be reflected off of the reflective face of the sign to provide the necessary lighting for the sign. However, with this system, whenever the light bulb burns out, a repairperson must replace the light bulb with another light bulb. This may cause a problem in that a road has to be blocked off for a particular amount of time during the bulb replacement, especially when the sign is located above the road.

U.S. Pat. No. 4,005,538, issued to C. Tung, discloses an internally illuminated retroreflective sign that has an array of tubular light bulbs that provide the internal light source when not enough reflective light is available to make the sign visible to a vehicle operator. The tubular lights bulbs may have to be replaced from time to time, which may involve a closure of a road, if the sign is located above the road and thus a repair truck must block the road during the time the repair is being made. Also, an undesirable shadowing effect may be created by the use of the tubular light bulbs disposed behind the retroreflective sheeting.

3M has also utilized something known as OLF, or optical lighting film, so as to provide a light source from a location separate from the sign itself, such as in a box located on the side of road for a sign hung above the road. As in the Tung et al. reference, however, the separately located light source uses incandescent bulbs or the like, and is prone to fairly frequent replacement.

U.S. Pat. Nos. 5,300,783, and 5,315,491, issued to A. Spencer et al., disclose the use of a retroreflective material having a prism-like surface, with an electroluminescent lamp disposed within a central region behind the retroreflective material. The electroluminescent lamp is composed of a flexible material, and is not protected from the internal atmosphere in the central region. This may cause the lamp to breakdown over time, requiring relatively frequent replacement.

Great Britain Published Patent Application GB 2 099 628A discloses a device having a mirror with an electroluminescent element mounted its rear face. The device is used as an interior rear view mirror for a vehicle, and the device does not provide any protective capability for the electroluminescent element.

For all of the signs/reflecting devices discussed above, there is a problem in that the life span of these devices is limited due to the exposure of important components to the atmosphere and/or neighboring components.

SUMMARY OF THE INVENTION

It is an object of the present invention to provide a traffic sign that has a long life span, and need not be repaired as often as conventional signs.

It is another object of the present invention to provide a traffic sign that is more efficient than conventional illuminated signs and operates with less power than such conventional signs.

It is a further object of the present invention to provide a traffic sign having a solid state component so as to increase the life span of the sign.

The above-mentioned objects and advantages can be achieved by a method of making a traffic sign. The method includes a step of placing a cryophotonic panel into a central location with a receptacle. The method also includes a step of pouring potting material in liquid form into the receptacle. The method further includes a step of, after the potting material has hardened into solid form, applying a translucent retroreflective sheeting to a top surface of the potting material.

The above-mentioned objects and other advantages of the invention can also be achieved by a traffic sign that includes a cryophotonic panel connected to receive a source of power and to provide a light output as a result. The traffic sign further includes a transparent potting material in which the cryophotonic panel is disposed. The traffic sign still further includes a transparent substrate having a translucent retroreflective sheeting disposed on one surface thereof, where the transparent substrate is removably attached to the transparent potting material. The light output from the cryophotonic panel passes substantially through the transparent potting material, the transparent substrate and the translucent retroreflective sheeting, so as to provide a back-lighting capability for the traffic sign.

BRIEF DESCRIPTION OF THE DRAWINGS

The above-mentioned objects and advantages of the invention will become more fully apparent from the following detailed description when read in conjunction with the accompanying drawings, with like reference numerals indicating corresponding parts throughout, and wherein.

DETAILED DESCRIPTION OF THE PREFERRED EMBODIMENTS

Preferred embodiments of the invention will be discussed hereinbelow with reference to the drawings. The use of retroreflectors in traffic signs so as to provide a lighting capability of such signs during low ambient light conditions, such as at night, has been incorporated into most conventional traffic signs. A retroreflector receives light that impinges on it at a particular angle, and reflects the light back in the same direction from which the light came. Retroreflectors have been constructed with tiny glass beads disposed in a plastic cover or plate, such as in the manner disclosed in the Pauline et al. reference. Current retroreflectors use a thin plastic sheeting with tiny prisms on one side thereof, in which the prisms provide the retroreflective capability. 3M is at the present the major manufacturer of retroreflective sheeting for traffic signs. Such a retroreflective sheeting has a capability of reflecting a majority of the light incident upon it back to a direction from which the light came.

For vehicles made to operate in the United States, vehicle headlights are typically aimed downwards and to the right. Signs on the right side of a road get the bulk of the light output by the headlights. Typically, about 75–80% of the ambient light from the headlights impinge signs located on the right side of the road, providing a strong lighting capability for signs that have a retroreflective capability. Signs located overhead typically get about 25–30% of the ambient light from the headlights, and signs located on the left side of the road typically get about only 15–18% of the ambient light from the headlights. For signs located in these two areas, the ambient light from a vehicle's headlights may not be enough to provide sufficient lighting so as to make the sign visible, even when the sign has a retroreflective capability.

Thus, many signs have their own internal light sources that provide needed light when the ambient light is not enough. Some of these types of signs have been discussed hereinabove, and tend to require fairly frequent repair and/or replacement of the internal light sources, and also require relatively large amounts of electricity to power the light sources.

As discussed hereinabove, 3M has developed a sheeting that allows for light from an internal light source to shine through a retroreflective sheeting when ambient light is not strong enough to provide sufficient light to make the sign visible. The present invention improves on this concept so as to provide a solid-state capability for a back light source, so that the combination of a solid-state light source and a retroreflective sheeting provides a long-lasting and durable traffic sign.

Figure 1:
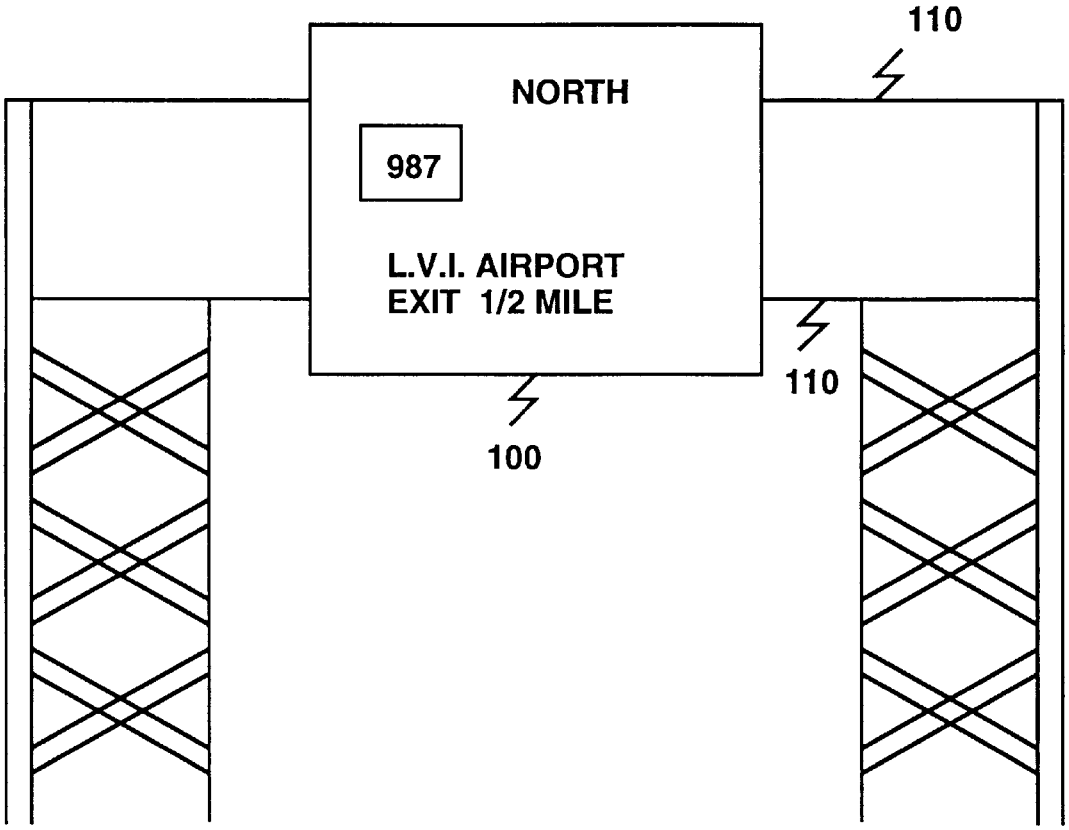
FIG. 1 shows a sign according to the present invention that is disposed above a road.

FIG. 1 shows a sign according to the present invention, which is disposed atop a road (not shown). The sign 100 is disposed on two horizontal members 110, and is connected to the two horizontal members in a manner known to those of ordinary skill in the art. The affixing of traffic signs to streetposts and other types of street fixtures (i.e., such as by using I-beams and typical extractions) is outside the scope of the invention and is also known to those of ordinary skill in the art. Thus, such affixing of signs to posts and the like is not discussed hereinbelow in order to simplify the explanation of the present invention.

Figure 2:
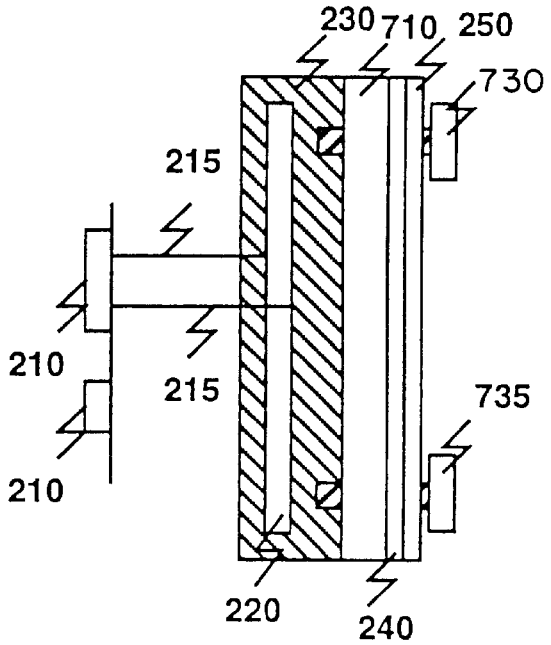
FIG. 2 shows individual components of a sign according to a first embodiment of the invention.

FIG. 2 shows the separate components making up a sign 100 according to a first embodiment of the invention. An AC ballast 210 provides AC voltage for the sign 100. The AC ballast 210 may be configured as an AC/DC converter or equivalent, depending upon the power source available. AC/DC converter converts DC current into AC current. In particular, AC ballast 210 provides an 800 Hz, 160 volt AC voltage for a cryophotonic panel 220 housed inside the sign 100. One of more AC ballasts may be furnished for the sign 100, depending on the number of lamps 220 disposed within the sign 100. Each ballast preferably would be an outdoor, cold weather start, constant wattage ballast of the appropriate wattage for each cryophotonic lamp required for a back lit sign according to the invention. The purpose of the AC ballast 210 is to convert an available source of power (DC or AC) to a particular AC power that is used by the cryophotonic panel 220. While the present invention has been explained with reference to a cryophotonic panel 220 that requires 800 Hz, 160 volt AC, it will be understood to one of ordinary skill in the art that the AC ballast will provide the necessary AC voltage to suit whatever power requirements are needed for the cryophotonic panel 220.

In the first embodiment, conductors 215 from each AC ballast provide power to each respective cryophotonic panel receptacle, and preferably are of the required type and temperature rating to meet U.L. sign listing requirements. If required, conductors 215 are housed in flexible metal conduit of the appropriate size, as described in Article 350 of the current edition of the National Electrical Code. In the first embodiment, a sufficient conductor length (or length of flexible conduit, if required) is provided to allow for easy maintenance of the cryophotonic lamp, ballast, or lamp receptacle.

As explained above, AC ballast 210 applies the appropriate AC power to the cryophotonic panel 220. In particular, positive charge is applied to one surface of the lamp 220 via a conductor line 215, and negative charge to an opposite surface of the lamp 220 via a conductor line 215. With AC power supplied to it, the cryophotonic panel 220 acts as an open capacitor, in which a ceramic layer mixed with phosphor crystals composing one surface of the cryophotonic panel 220 is excited and emits energy as light, thereby creating a "glow" effect.

In the first embodiment, the cryophotonic panel 220 has a first surface that comprises a steel backing plate. The first surface faces the AC ballast 210. The second surface of the lamp 220 faces away from the AC ballast, and that is the surface in which a ceramic layer mixed with phosphor crystals is disposed.

Cryophotonic panel 220 corresponds to a thin piece of steel that has a ceramic layer with phosphor crystals baked onto one side of the steel. The construction of the cryophotonic panel 220 is described hereinbelow. First, a thin sheet of 22-gauge steel is obtained. Then, one side of the steel sheet is decarbonized. Next, a ceramic coating is applied to the decarbonized side of the steel sheet at approximately 1700 degrees F., so as to form a ceramic layer. Next, phosphor is applied to the ceramically-coated side at approximately 500 degrees F., thereby forming phospor crystals on the ceramic layer. Note that application of phosphor at a higher temperature may degrade the quality of the phosphor. Then, a protection layer is baked onto the steel sheet at approximately 1500 degrees F.

At present, CELCO, Inc., based in Lewisburg, W.Va., manufactures cryophotonic panels that may be used in the present invention to provide back-lighting for traffic signs. Such cryophotonic panels provide cold, thin, durable and energy-efficient light for back-lighting applications. Cryophotonic panels or "lamps" are quite literally sheets of flat steel, which are specially coated (as described above) to illuminate when energized. These "lamps" do not utilize any filaments, glass, fragile components or gas in their construction, and therefore are very durable and require low maintenance throughout their very long lamp lives. Cryophotonic lamps are about 95% more efficient than conventional light sources, and thereby provide an energy-savings capability. For example, according to CELCO, Inc., a conventional incandescent EXIT sign uses approximately 30 watts of continuous power, while an EXIT sign with a cryophotonic lamp uses about one watt of continuous power and requires less maintenance. Cryophotonic lamps are different from conventional lamps in that most conventional light is obtained as a by-product of electricity being converted into heat at a single point source. By comparison, cryophotonic "light" is created through a direct energy-to-light conversion process (over the entire surface area of the lamp). In this process, virtually no heat is generated, and an evenly-lit area is produced.

Specifications for a cryophotonic panel, obtained from CELCO, Inc., are detailed in Table 1.

TABLE 1

| Cryophotonic Panel Product specifications |
|---|
| Panels shall have a normal operating voltage of 150 VAC +/− 10% RMS, 350 to 800 Hz. |
| Breakdown voltage: breakdown voltage shall not be less than 1.3 times normal operating voltage. |
| Panels will be capable of a minimum service life of 150,000 hours. |
| Under test conditions, operating at 40 degrees C. and 100% RH for 200 hours, panels will show no evidence of arcing and no functional degradation. |
| Panel performance will show no degradation due to UV exposure. |
| Panels will show no evidence of physical degradation and will be operable after storage at any temperature between −90 degrees C. and +200 degrees C. |
| Panels will be capable of meeting all performance requirements while operating in a temperature range of −73 degrees C. to +149 degrees C. |
| Each panel is processed in such a manner as to be uniform in quality and free from defects that will effect the panel's life, serviceability and appearance. |

In the first embodiment, the cryophotonic panel or lamp 220 is potted in a potting material 230. The potting material 230 is preferably a two-part epoxy, which is mixed together and then poured into a shell composed of polycarbonate, plastic, or equivalent. The elements making up the two parts of an epoxy (to be later mixed together) are known to those of ordinary skill in the art.

Preferably, the mixed epoxy that comprises the potting material 230 has at least a 98% transmission capability, so that most of the light emanating from the lamp 220 passes through the potting material and towards the front face of the sign 100. Preferably, the potting material 230 also should be capable of withstanding extreme outdoor conditions, such as being capable of withstanding 100 mph wind loads with a 20% gust protection, and also should resist shattering.

In the present invention, the wafer-thin steel plate that comprises the lamp 220 is potted in the epoxy mixture 230. Preferably, the thin steel plate has a thickness on the order of 0.040 inches, and is thick enough to provide a strong enough backing for the lamp 220. The potting process is a three-step process. In a first step, a backing plate 232, such as hard plastic, is provided. In a second step, a frame 234 is built around the backing plate 232. The frame 234 and the backing plate 232 together comprise a lamp receptacle. In a third step, the two parts of the epoxy are mixed together, and the mixture is poured onto the lamp receptacle, with the lamp 220 disposed in a middle portion thereof. That way, the lamp 220 is entirely encapsulated within the potting material 230, and is protected from the elements, so as to provide a long-lasting system. In effect, the lamp 220 is suspended within the potting material 230, and it is only exposed to external components via the conductor lines 215 providing the power from the AC ballast 210 to both sides of the lamp 220.

When the epoxy mixture is poured into the receptacle, a template is also placed into the receptacle, so as to form a hardened potting material 230 that has two holes for accepting bolts to be screwed into the holes.

In the first embodiment, a retroreflective sheeting 240 is attached to a surface of a transparent substrate 710, which can be, for example, a PLEXIGLASS (e.g., light, transparent, weather-resistant thermoplastic) plate or equivalent. Like the potting material 230, the transparent substrate 710 has very good light transmissive characteristics. Typically, retroreflective sheetings have an adhesive on one side thereof, and so the adhering of the retroreflective sheeting to the substrate 710 is a relatively straight-forward process. ECF film 250 is then attached on top of the retroreflective sheeting 240. Like the retroreflective sheeting, ECF film typically have an adhesive side. In the first embodiment, the substrate 710 is formed having openings for receiving bolts 730, 735. Bolts 730, 735 provide the means for adhering the substrate 710 onto the potting material 230, once the potting material 230 has hardened. As explained earlier, potting material 230 is constructed with bolt-receiving holes for receiving the bolts 730, 735.

With the solid-state nature of a sign according to the present invention, servicing of signs will be less often than conventional signs. Also, the power required for the cryophotonic lamp is typically much less than the power required for signs that use incandescent or similar types of light sources. Based on information currently available, as given in Table 1, the cryophotonic lamp used in the present invention has about a 150,000 hour life span. Since the lamps will typically only be turned on at night, this corresponds to about a 25-year life span. Current retroreflective sheetings has a life span of about 10 years, based on information obtained from 3M for their sheetings. Thus, the sheetings will tend to break down much sooner than the lamps. Thus, it is desirable to have a structure such that the lamp portion can be retained while replacing a retroreflective sheeting portion of a sign made that has deteriorated over time. In situations where the lamp 220 becomes defective before the retroreflective sheeting 240 breaks down, it will be relatively easy to replace the portion of the sign containing the potting material 230 and the lamp 220 with a new one, while still utilizing the still-useful retroreflective sheeting 240.

The configuration according to the first embodiment allows for the easy removal of the transparent substrate 710 from the potting material 230. When the retroreflective sheeting deteriorates, say, after 10 years after installing the sign, the bolts 730, 735 can be removed from the rest of the sign, so as to allow one to remove the deteriorated retroreflective sheeting and to affix a new sign face with a new retroreflective sheeting onto the existing potting material 230 (with the cryophotonic lamp disposed within). That way, the cryophotonic lamp 220 need not be replaced when the retroreflective sheeting 240 deteriorates, and it is a relatively simple matter to affix another transparent substrate (onto which a retroreflective sheeting, ECF film and sign cutting are also affixed).

One example of a retroreflective sheeting that can be used in the present invention is a Series 3990T Scotchlite Translucent Reflective Diamond Grade Sheeting, manufactured by 3M, or any equivalent thereof. This type of retroreflective sheeting has a retroreflective capability and also transmits light received from its reverse side (that is, from the side that does not have the retroreflectors disposed thereon). That way, the light created by the lamp 220 passes through the sheeting 240 so as to provide a lighting capability of the sign 100 when ambient light is low (i.e, at night).

As explained above, retroreflective sheetings typically have an adhesive side, and it is a simple matter to adhere the retroreflective sheeting 240 to the PLEXIGLASS (e.g., light, transparent, weather-resistant thermoplastic) sheet. Once the retroreflective sheeting 240 has been put into place, in a next step, an electronic cutting film (ECF) 250 or equivalent is adhered to the top surface of the retroreflective sheeting 240, if required for the sign 100. ECF 250 provides a color capability for the light, so that something other than white color can be used with the sign 100. ECF 250 can be understood as a translucent sheeting that provides an appropriate color (e.g., green) to portions of the sign 100. Without the ECF 250, the white light from the lamp 220 and the white light reflected by the retroreflective sheeting 240 will only provide a white color for illuminating the sign 100. ECF 250 allows substantially all light impinging on its reverse side to pass through its front side, and vice versa. Finally, sign copy is provided on the ECF 250. The sign copy provides the lettering for the sign, and can be screened on or laminated on the sign 100, or by any other method known to those of ordinary skill in the art. The sign copy decoration (background and legend for each sign face) preferably meets minimum requirements set by the government, such as those listed below in Tables 2 and 3. The sign copy decoration should also preferably meets FP 85 and LS300C requirements.

TABLE 2

| Minimum Coefficient of Retroreflection (Candela/Foot Candle/Square Foot) | | |
|---|---|---|
| Observation Angle | Entrance Angle | White |
| 0.2 | −4 | 430 |
| 0.33 | −4 | 300 |
| 0.5 | −4 | 250 |
| 1.0 | −4 | 80 |
| 0.2 | +30 | 235 |
| 0.33 | +30 | 150 |
| 0.5 | +30 | 170 |
| 1.0 | +30 | 50 |
| 0.2 | +40* | 150 |
| 0.33 | +40* | 85 |
| 0.5 | +40* | 35 |
| 1.0 | +40* | 20 |

*For the +40 degree entrance angle, the orientation angle shall be 90 degrees.

TABLE 3

| C/E Chromaticity Coordinate Limits | | | | | | | | | | |
|---|---|---|---|---|---|---|---|---|---|---|
| | | | | | | | | | Refl Lim. (Y) | |
| Color | X | Y | X | Y | X | Y | X | Y | Min | Max |
| White | .305 | .305 | .355 | .355 | .335 | .375 | .285 | .325 | 35 | — |
| Yellow | .487 | .423 | .545 | .454 | .465 | .534 | .427 | .483 | 24 | 45 |
| Green | .030 | .398 | .166 | .364 | .286 | .446 | .201 | .794 | 3 | 9 |
| Blue | .078 | .171 | .150 | .220 | .210 | .160 | .137 | .038 | 1 | 10 |

The process of providing an ECF sheeting and sign copy to a sign is not important to an understanding of the present invention and is known to those skilled in the art, and will not be discussed in detail. For example, ECF sheeting typically has an adhesive surface which can be squeeze-rolled to the retroreflective sheeting 240.

The cryophotonic lamp 220, which is internal to the sign 100, is preferably constructed such that an observer will experience a suitable light intensity on the white portion of the sign face, including retroreflection.

Figure 3A:
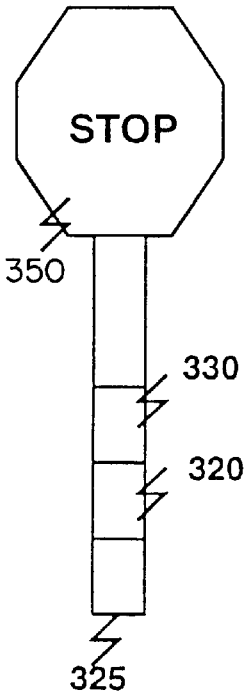
FIGS. 3A and 3B respectively show a front and back view of a sign according to a second embodiment of the invention.
Figure 3B:
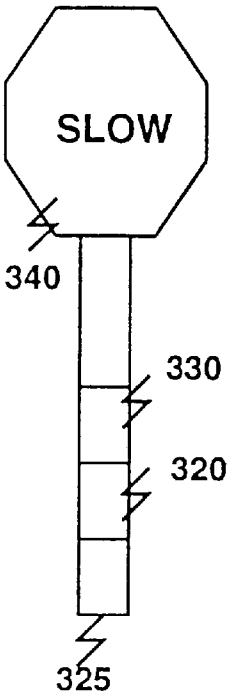

FIGS. 3A and 3B show the front and back of a sign according to a second embodiment of the invention. In FIGS. 3A and 3B, a hand-held sign 300 has sign copy on one side 350 thereof ("STOP"), and sign copy on an opposite side 340 thereof ("SLOW"). In the second embodiment, instead of requiring an AC ballast as a power supply external to the sign, the second embodiment includes an internal battery 320 and an internal DC/AC converter 330 that are both disposed within a handle 325 of the hand-held sign 300.

The internal battery 320 may be any type of battery that can provide sufficient power for the sign 300, such as a nickel-cadmium battery or the like. DC/AC converter 330 converts the DC power supplied by the battery 320 into AC power, so as to provide the needed power for a cryophotonic lamp (not shown) that is disposed in the top portion 340 of the sign 300. The construction of the sign 300 according to the second embodiment is similar to the structure shown in FIG. 2, but with the cryophotonic lamp having a slightly different structure. In the second embodiment, the cryophotonic lamp has a steel plate that provides the backing, with ceramic beads and phosphor crystals disposed on both sides of the steel plate, as opposed to just one side as in the first embodiment. In the second embodiment, one side of the lamp faces one side of the sign 300 (e.g., the "STOP" side) and provides the backup light for that one side of the sign 300. The other side of the lamp faces the other side of the sign 300 (e.g., the "SLOW" side) and provides the backup light for that other side of the sign 300.

Figure 4:
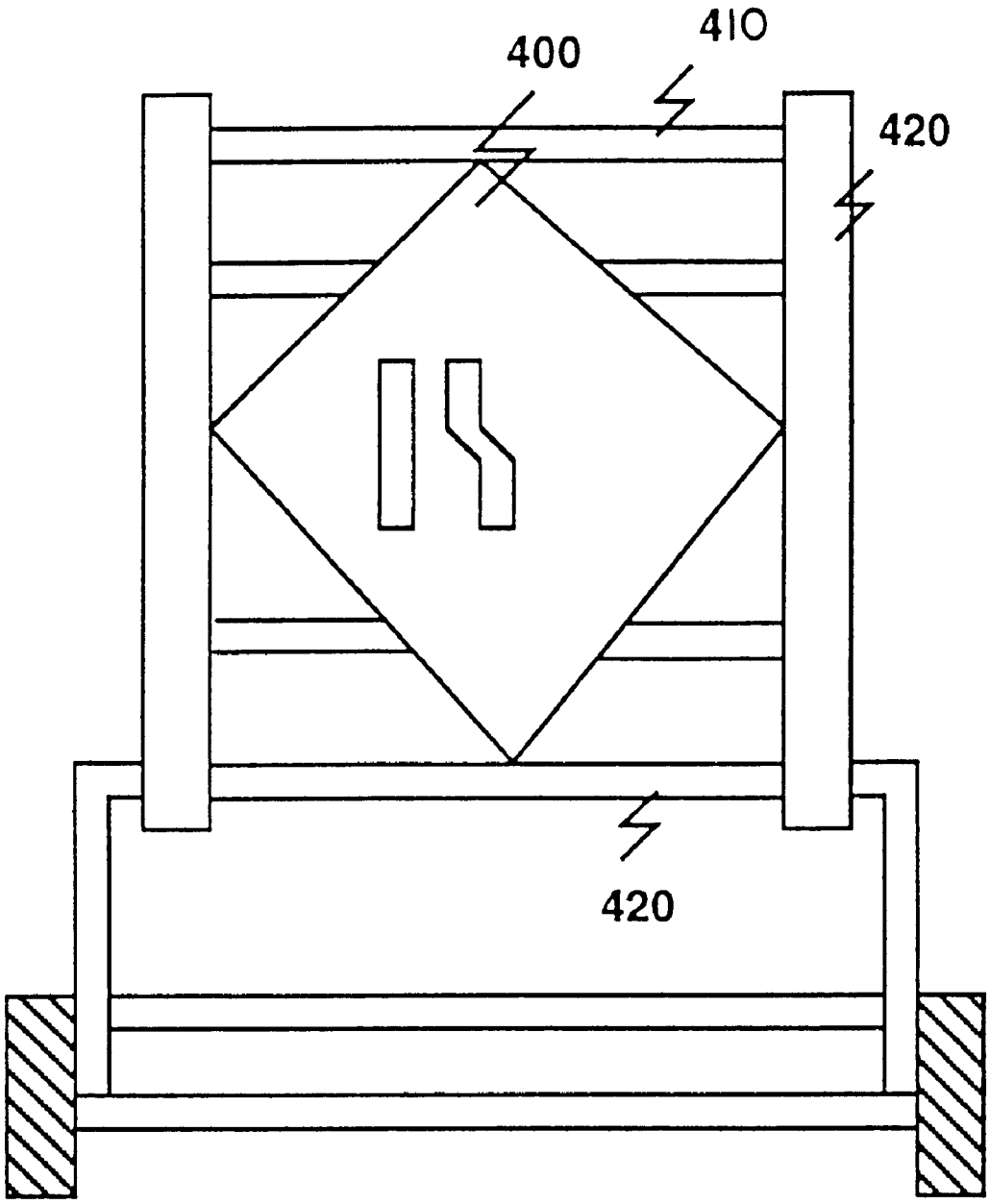
FIG. 4 shows a sign according to a third embodiment of the invention.

The source of DC power may be provided be any of a variety of ways. For example, FIG. 4 shows a sign 400 according to a third embodiment of the invention, with the sign 400 being disposed on a housing 410. Housing 410 includes solar panels 420, which provide DC power to a DC/AC converter (not shown) disposed on the housing 410.

Figure 5:
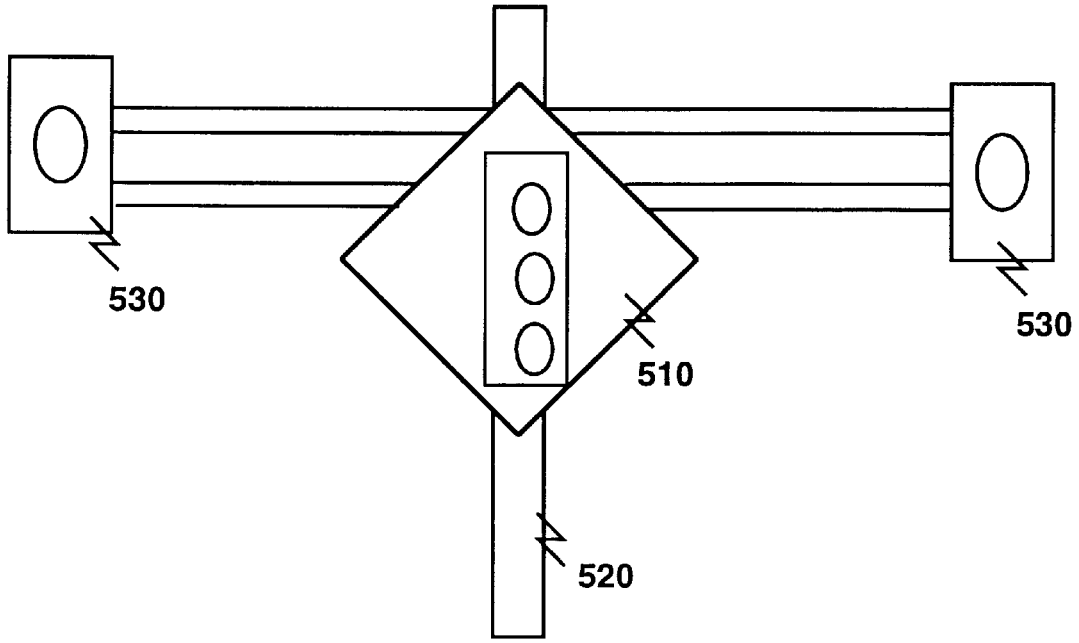
FIG. 5 shows a sign according to the present invention that is disposed on a side of a road.
Figure 6:
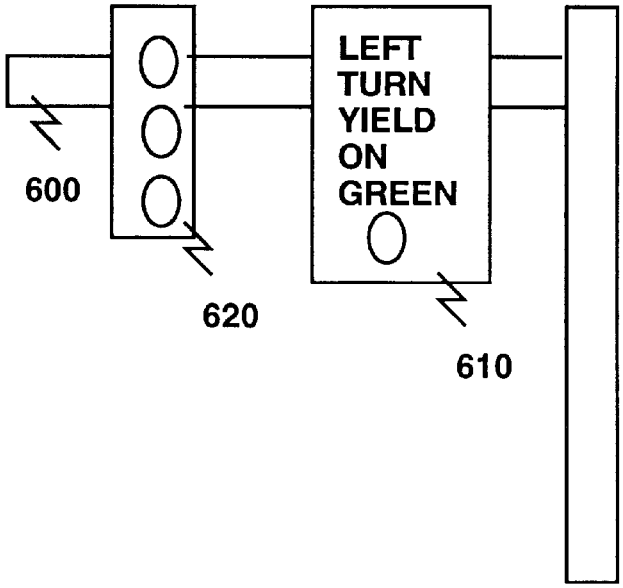
FIG. 6 shows a sign according to the present invention that is disposed on a pole that is situated over the road.

FIGS. 5 and 6 show typical AC power supply applications for a sign according to the present invention. In FIG. 5, a traffic sign 510 is mounted onto a pole 520 that is disposed on a side of a road. Also, traffic signs 530 are also disposed on the pole 520, and provide an alternate-blinking-light feature. The sign 510 indicates that a traffic light is upcoming. The sign 510 is configured as described in the present invention. FIG. 6 shows a sign 610 disposed on a pole 600 that extends over a road. A traffic light 620 is also disposed on the pole, and sign 610 is configured according to the present invention.

The signs according to the present invention can readily replace signs made by conventional methods and components, such that sign 510 of FIG. 5 and sign 610 of FIG. 6 can be fitted onto a location where a previous sign was situated that did not have the lighting capability of the sign according to the present invention. This is the case since a sign according to the present invention is a solid-state component that does not require anything more than an AC power supply, which is typically available where signs are currently utilized.

Figure 7:
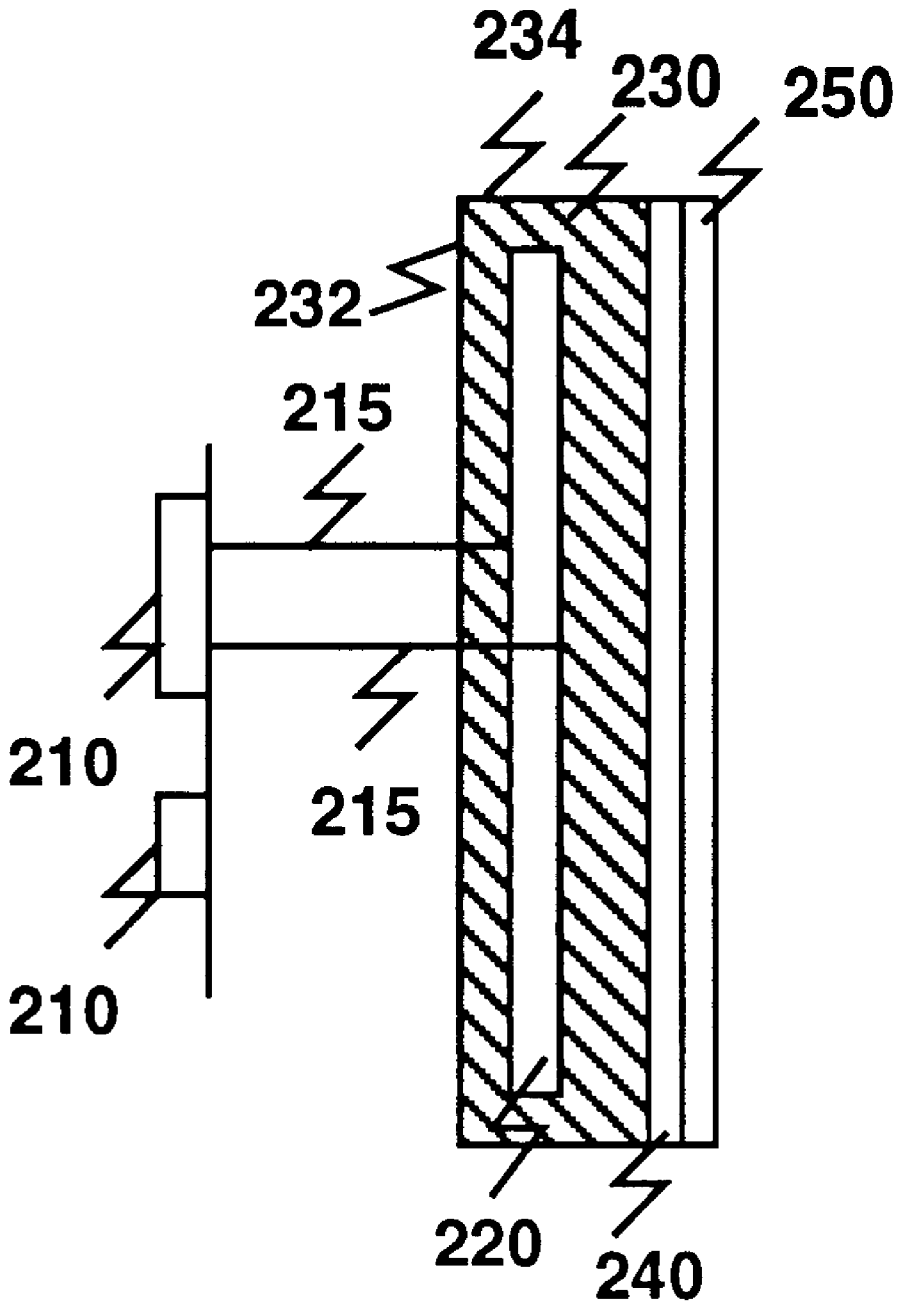
FIG. 7 shows a sign according to a fourth embodiment of the invention.

A fourth embodiment of the present invention is shown in FIG. 7. In FIG. 7, instead of using a transparent substrate that is bolted to a potting material, a retroreflective sheeting 240 is adhered directly to a top surface of the hardened potting material 230. An ECF film 250 is then adhered directly to a top surface of the retroreflective sheeting 240. The configuration according to the fourth embodiment does not allow for easy removal of the retroreflective sheeting 240 from the base of the sign, but may be useful in applications where the sign's life is 10 years or less, and where there would be no need to recycle the still-useful lamp 220 housed in the potting material 230.

While embodiments have been described herein, modification of the described embodiments may become apparent to those of ordinary skill in the art, following the teachings of the invention, without departing from the scope of the invention as set forth in the appended claims.

For example, while the embodiments have been described with respect to the use of a cryophotonic lamp to provide a back lighting capability, other types of devices may be encapsulated in a potting material, to be used with a retroreflective sheeting so as to provide a solid-state back lighting capability that may not be as good as a cryophotonic lamp, but which may be acceptable to suit particular applications.

For example, several companies currently manufacture electroluminescent lamps. Electroluminescent lamps have luminous crystals disposed on one side of a support. When the luminous crystals are excited with electricity, they emit energy as light. One company that manufactures electroluminescent lamps is Planar Systems of Beaverton, Oreg., which makes thin glass sheets that are restricted in size, and which are used primarily in the medical industry. These thin glass sheets have a short lift span, and would have to be modified extensively to be used for traffic sign back lighting applications. Pioneer New Media Technologies, of Long Beach, Calif., also makes electroluminescent lamps. Their lamps are flexible, and are constructed on a plastic sheet. These lamps also have a short life span, and would also have to be modified extensively to be used for traffic sign back lighting applications. To be used as an alternative to cryophotonic panels or lamps as in the embodiments of the present invention, modified versions of the electroluminescent lamps (modified so as to provide a lamp that would be more hardened for outdoor applications) would be encapsulated in a potting material, and then a retroreflective sheeting would be applied (either by bolting via a transparent substrate or by adhering directly to the potting material, as explained above).

What is claimed is:

1. A traffic sign, comprising:

a cryophotonic unit connected to receive a source of power and to provide output light;

a potting material in which the cryophotonic unit is disposed;

a transparent substrate removably attached to the potting material; and a retroreflective sheeting disposed on one surface of the transparent substrate, wherein the output light from the cryophotonic unit passes substantially through the potting material, the transparent substrate, and the retroreflective sheeting, so as to provide a back lighting capability for the traffic sign.

2. The traffic sign according to claim 1, wherein the potting material provides a solid-state configuration for the cryophotonic unit, and wherein the potting material is formed from a two-part epoxy.

3. The traffic sign according to claim 1, further comprising an electronic cuttable film disposed on a surface of the retroreflective sheeting.

4. The traffic sign according to claim 1, wherein the source of power is an AC ballast that provides AC power to the cryophotonic unit.

5. The traffic sign according to claim 1, wherein the cryophotonic unit comprises:

a steel sheet providing a backing;

a ceramic layer disposed on one side of the steel sheet; and phosphor crystals disposed on the ceramic layer, the one side of the steel sheet being a side of the steel sheet that faces the retroreflective sheeting.

6. The traffic sign according to claim 5, further comprising a receptacle having sidewalls and a backing that face the power supply, wherein the potting material is disposed in the receptacle, and wherein the cryophotonic unit is disposed in a central region of the receptacle, the cryophotonic unit being held in place by the potting material in a hardened state.

7. The traffic sign according to claim 1, wherein the cryophotonic unit comprises:

a steel sheet providing a backing, the steel sheet having a first side and a second side opposite the first side;

a first ceramic layer disposed on the first side of the steel sheet;

a second ceramic layer disposed on the second side of the steel sheet; and phosphor crystals disposed on each of the first and second ceramic layers, wherein the first side faces one outer surface of the traffic sign having a first sign lettering, wherein the second side faces a second outer surface of the traffic sign having a second sign lettering, and wherein the one outer surface faces an opposite direction as the second outer surface.

8. The traffic sign according to claim 1, wherein the source of power is provided by a solar panel, and wherein the traffic sign further comprises an AC/DC converter for converting output power from the solar panel into AC power for the cryophotonic unit.

9. The traffic sign according to claim 1, wherein the transparent substrate is a thermoplastic plate.

10. The traffic sign according to claim 9, wherein the retroreflective sheeting has a transmissive characteristic that allows at least 30% of light entering from a back side of the sheeting to pass through to a front side of the sheeting, wherein the front side of the sheeting has a retroreflective characteristic.

11. The traffic sign according to claim 1, wherein the potting material covers an entire exterior surface area of the cryophotonic unit.

12. The traffic sign according to claim 11, wherein the potting material is not disposed within the cryophotonic unit, and wherein the cryophotonic unit is held in place within the traffic signal by the potting material in a hardened state.

13. The traffic sign according to claim 1, wherein the potting material is a separate and distinct component from the cryophotonic unit.

14. A hand-held traffic sign, comprising:

a source of power disposed in a handle of the traffic sign;

an cryophotonic unit connected to receive the source of power and to provide a light output as a result, the cyrophotonic unit being disposed on a sign portion of the traffic sign that is connected to the handle;

a potting material in which the cryophotonic unit is disposed, the potting material being disposed on the sign portion of the traffic sign;

a transparent substrate removably attached to the potting material; and a retroreflective sheeting adhesively attached to the transparent substrate, the retroreflective sheeting being disposed on the sign portion of the traffic sign, wherein the light output from the cryophotonic unit passes substantially through the potting material, the transparent substrate, and the retroreflective sheeting, so as to provide a back-lighting capability for the traffic sign.

15. The hand-held traffic sign according to claim 14, wherein the source of power includes a battery and a DC/AC converter.

16. The traffic sign according to claim 14, wherein the cryophotonic unit comprises:

a steel sheet providing a backing, the steel sheet having a first side and a second side opposite the first side;

a first ceramic layer disposed on the first side of the steel sheet;

a second ceramic layer disposed on the second side of the steel sheet; and phosphor crystals disposed on each of the first and second ceramic layers, wherein the first side faces one outer surface of the traffic sign having a first sign lettering, wherein the second side faces a second outer surface of the traffic sign having a second sign lettering, and wherein the one outer surface faces an opposite direction as the second outer surface.

17. The traffic sign according to claim 14, wherein the transparent substrate is a thermoplastic plate.

18. The traffic sign according to claim 14, wherein the potting material covers an entire exterior surface area of the cryophotonic unit.

19. The traffic sign according to claim 18, wherein the potting material is not disposed within the cryophotonic unit, and wherein the cryophotonic unit is held in place within the traffic signal by the potting material in a hardened state.

20. The traffic sign according to claim 14, wherein the potting material is a separate and distinct component from the cryophotonic unit.

* * * * *